US010378073B2

(12) United States Patent
Wang et al.

(10) Patent No.: US 10,378,073 B2
(45) Date of Patent: Aug. 13, 2019

(54) HIGH-TOUGHNESS HOT-ROLLING HIGH-STRENGTH STEEL WITH YIELD STRENGTH OF 800 MPA, AND PREPARATION METHOD THEREOF

(71) Applicant: BAOSHAN IRON & STEEL CO., LTD., Shanghai (CN)

(72) Inventors: Huanrong Wang, Shanghai (CN); A'na Yang, Shanghai (CN); Wei Wang, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 188 days.

(21) Appl. No.: 15/514,510

(22) PCT Filed: Jan. 15, 2015

(86) PCT No.: PCT/CN2015/070727
§ 371 (c)(1),
(2) Date: Mar. 25, 2017

(87) PCT Pub. No.: WO2016/045266
PCT Pub. Date: Mar. 31, 2016

(65) Prior Publication Data

US 2017/0275719 A1 Sep. 28, 2017

(30) Foreign Application Priority Data

Sep. 26, 2014 (CN) ..... 2014 1 0503735

(51) Int. Cl.
*C21D 8/02* (2006.01)
*C22C 33/04* (2006.01)
(Continued)

(52) U.S. Cl.
CPC ..... *C21D 8/0263* (2013.01); *C21D 8/0226* (2013.01); *C22C 33/04* (2013.01);
(Continued)

(58) Field of Classification Search
CPC ..... C21D 2211/008; C21D 8/0226; C21D 8/0263; C22C 33/04; C22C 38/001;
(Continued)

(56) References Cited

U.S. PATENT DOCUMENTS 6,254,698 B1 * 7/2001 Koo ..... C21D 1/19 148/332
2011/0079328 A1 * 4/2011 Yokoi ..... C21C 7/0006 148/504
(Continued)

FOREIGN PATENT DOCUMENTS

CN 1265711 A 9/2000
CN 1840723 A * 10/2006
(Continued)

OTHER PUBLICATIONS

English Translation of CN 1840723 (Year: 2006).*
(Continued)

*Primary Examiner* — Veronica F Faison
(74) *Attorney, Agent, or Firm* — Thomas I Horstemeyer, LLP

(57) ABSTRACT

A high-toughness hot-rolled high-strength steel with a yield strength of Grade 800 MPa with its chemical components, in weight percentages, being C 0.02-0.05%, Si≤0.5%, Mn 1.5-2.5%, P≤0.015%, S≤0.005%, Al 0.02-0.10%, N≤0.006%, Nb 0.01-0.05%, Ti 0.01-0.03%, 0.03%≤Nb+Ti≤0.06%, Cr 0.1%-0.5%, Mo 0.1-0.5%, B 0.0005-0.0025%, and the balance of Fe and unavoidable impurities, and a preparation method thereof. The present invention acquires, via direct quenching, an ultra-low carbon martensite structure with a yield strength of 800 Mpa and an impact energy of more than 100J under a temperature of −80° C.

10 Claims, 3 Drawing Sheets

(51) Int. Cl.

| | |
|---|---|
| ***C22C 38/38*** | (2006.01) |
| ***C22C 38/00*** | (2006.01) |
| ***C22C 38/02*** | (2006.01) |
| ***C22C 38/06*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |

(52) U.S. Cl.
CPC ..... *C22C 38/001* (2013.01); *C22C 38/002* (2013.01); *C22C 38/004* (2013.01); *C22C 38/02* (2013.01); *C22C 38/06* (2013.01); *C22C 38/22* (2013.01); *C22C 38/26* (2013.01); *C22C 38/28* (2013.01); *C22C 38/32* (2013.01); *C22C 38/38* (2013.01); *C21D 2211/008* (2013.01)

(58) Field of Classification Search
CPC ..... C22C 38/002; C22C 38/004; C22C 38/02; C22C 38/06; C22C 38/22; C22C 38/26; C22C 38/28; C22C 38/32; C22C 38/38
See application file for complete search history.

(56) References Cited

U.S. PATENT DOCUMENTS

| | | | | |
|---|---|---|---|---|
| 2014/0116578 | A1* | 5/2014 | Zhang | C22C 38/001 148/541 |
| 2015/0354041 | A1* | 12/2015 | Song | C22C 33/04 148/541 |

FOREIGN PATENT DOCUMENTS

| | | | | |
|---|---|---|---|---|
| CN | 1936055 | A | * | 3/2007 |
| CN | 101487096 | A | * | 7/2009 |
| CN | 103233183 | A | | 8/2013 |
| JP | H09104946 | | | 4/1997 |
| JP | H01319630 | | | 12/1998 |
| JP | 2009242841 | | | 10/2009 |
| JP | 2010229528 | | | 10/2010 |
| RU | 2493286 | | | 9/2013 |
| WO | 2012141220 | | | 10/2012 |
| WO | 2012141220 | A1 | | 10/2012 |
| WO | 2012161248 | | | 11/2012 |
| WO | 2013022043 | | | 2/2013 |
| WO | 2013103125 | | | 7/2013 |

OTHER PUBLICATIONS

English Translation of CN 101487096 (Year: 2009).*
English Translation of CN 1936055 (Year: 2007).*
PCT/CN2015/070727 International Search Report and Written Opinion, dated Jun. 19, 2015.
Office Action dated Nov. 2, 2018 for Russian Application No. RU2017121061 with the English translation.

* cited by examiner

HIGH-TOUGHNESS HOT-ROLLING HIGH-STRENGTH STEEL WITH YIELD STRENGTH OF 800 MPA, AND PREPARATION METHOD THEREOF

CROSS-REFERENCE TO RELATED APPLICATIONS

This application is a 371 U.S. National Phase of PCT International Application No. PCT/CN2015/070727, filed on Jan. 15, 2015, which claims benefit and priority to Chinese patent application No. 201410503735.6, filed on Sep. 26, 2014. Both of the above-referenced applications are incorporated by reference herein in their entirety.

TECHNICAL FIELD

The invention pertains to the field of structural steel, and particularly relates to a high-toughness hot-rolled high-strength steel with a yield strength of Grade 800 MPa and a preparation method thereof.

BACKGROUND ART

In the engineering machinery industry manufacturing truck cranes, concrete pump trucks, concrete mixer trucks and the like, an increasing number of enterprises gradually increase the proportion of high-strength structural steel that is used. In design of new vehicles, a strategy of "increased strength and decreased thickness" is employed, and upgrading and updating of products is accelerated at the same time. Up to now, high-strength steel having a yield strength at the levels of 600 MPa and 700 MPa has been used widely. The use of high-strength steel having a yield strength of 800 MPa or higher is quite limited. In the compositional design of hot-rolled high-strength steel of Grades 600 MPa and 700 MPa, a high amount of titanium is added in most cases for predominant precipitation strengthening, and the structure is mainly granular bainite. High-titanium high-strength steel comprising granular bainite structure generally has a ductile-brittle transition temperature of about −40° C., and the impact performance varies greatly. At the same time, a use environment of −30° C. to −40° C. is required by some engineering machinery users, and a higher strength is also required. Under such a background, high-titanium hot-rolled high-strength steel not only fails to satisfy the requirement of strength, but it's more difficult for this steel to ensure low-temperature impact toughness. Hence, it's urgently necessary to develop a high-strength, high-toughness steel material having low cost.

Low-carbon or ultralow-carbon martensite is a multi-sized structure. The strength of low-carbon or ultralow-carbon martensite mainly depends on the size of lath bundles, and there is a Hall-Petch relationship between the strength and the size of lath bundles. As the size of lath bundles decreases, the strength and toughness of steel increases. Fine martensitic lath bundles can prevent propagation of cracks more effectively, so as to promote the low-temperature impact toughness of low-carbon or ultralow-carbon martensite steel. It's just on the basis of this concept of designing ultralow-carbon martensite that the present invention is proposed.

Chinese Patent Application No. 03110973.X discloses an ultralow-carbon bainite steel and a method of manufacturing the same. Because the end cooling temperature after water cooling is between the bainite transformation temperature Bs and the martensite transformation temperature Ms, or in a range of 0-150° C. lower than Bs, the strength of the steel is rather low. Even if relatively high amounts of Cu and Ni are added and medium- or high-temperature tempering is performed, the maximum yield strength of the steel plate is still lower than 800 MPa, and the structure is mainly ultralow-carbon bainite. In addition, when the Cu content exceeds 0.4%, tempering treatment must be conducted, which increases process steps and manufacture cost. Hence, the method disclosed by this patent application can only produce a series of high-strength steel having a relatively low strength, and the yield strength cannot reach 800 MPa or higher.

Chinese Patent Application No. 201210195411.1 discloses an ultralow-carbon bainite steel and a method of manufacturing the same. The essential design concept of this patent application is still the use of ultralow-carbon bainite with relatively precious alloy elements such as Cu, Ni, Cr, Mo and the like added in amounts as less as possible. Instead, addition of a medium amount of Mn is employed in the design concept. That is, the Mn content is controlled at 3.0-4.5%. It's well known that, when the Mn content is 3% or higher, the mechanical properties of the steel plate can be desirable. Nevertheless, for a steel plant, such a high Mn content will cause extreme difficulties in steel making, particularly in continuous casting, because cracks tend to be generated in a steel blank during continuous casting, and fracturing can easily occur during hot rolling, resulting in poor utility. Moreover, the carbon content in Example 4 is up to 0.07%. This amount of carbon is no longer ultralow carbon in its general sense.

SUMMARY

An object of the disclosure is to provide a high-toughness hot-rolled high-strength steel with a yield strength of Grade 800 MPa and a preparation method thereof, wherein the resulting steel plate still possesses excellent low-temperature impact toughness at a temperature in the range of from room temperature to −80° C., wherein the impact energy at −80° C. can reach 100 J or higher.

To achieve the above object, the technical solution of the disclosure is as follows:

The design concept of the disclosure is the use of ultralow-carbon martensite, wherein austenite grain size is reduced by combined addition of Nb and Ti; hardenability and temper softening resistance are improved by combined addition of Cr and Mo; a hot continuous rolling process is utilized to obtain ultralow-carbon martensite structure by direct quenching or low-temperature coiling, wherein the resulting high-strength structural steel has a yield strength of the level of 800 MPa and superior low-temperature impact toughness.

In particular, the chemical components of the high-toughness hot-rolled high-strength steel with a yield strength of Grade 800 MPa according to the disclosure, in weight percentages, are as follows: C 0.02-0.05%, Si≤0.5%, Mn 1.5-2.5%, P≤0.015%, S≤0.005%, Al 0.02-0.10%, N≤0.006%, Nb 0.01-0.05%, Ti 0.01-0.03%, 0.03%≤Nb+Ti≤0.06%, Cr 0.1%-0.5%, Mo 0.1-0.5%, B 0.0005-0.0025%, and the balance of Fe and unavoidable impurities.

Further, the hot-rolled high-strength steel has a yield strength ≥800 MPa, a tensile strength ≥900 MPa, an elongation ≥13%, and an impact energy at −80° C. of 100 J or higher.

The microstructure of the hot-rolled high-strength steel according to the disclosure is lath martensite.

In the compositional design of the high-strength steel according to the disclosure:

Carbon is an essential element in steel, and it's also one of the most important elements in the technical solution of the disclosure. As an interstitial atom in steel, carbon plays an important role for increasing steel strength, and has the greatest influence on the yield strength and tensile strength of steel. Typically, the higher the steel strength, the poorer the impact toughness. In order to obtain ultralow-carbon martensite structure, the carbon content in steel must be maintained at a low level. In accordance with the general classification of ultralow-carbon steel, the carbon content should be controlled at 0.05% or lower. Meanwhile, to ensure that the yield strength of the steel will reach 800 MPa or higher, the carbon content in the steel should not be too low; otherwise, the steel strength cannot be guaranteed. The carbon content is generally not lower than 0.02%. Therefore, a suitable carbon content in the steel should be controlled at 0.02-0.05%, and this can ensure that a steel plate will have high strength and good impact toughness with the aid of fine grain strengthening, etc.

Silicon is an essential element in steel. Silicon has some effect of removing oxygen in the process of steel making, and has a strong effect of strengthening a ferrite matrix at the same time. When the silicon content is relatively high, e.g. >0.8%, red scale defects tend to occur on the surface of a steel plate in hot rolling. Since it's the deoxygenating effect of silicon that is mainly utilized in the disclosure, it's acceptable so long as the silicon content is controlled within 0.5%.

Manganese is the most essential element in steel, and it's also one of the most important elements in the technical solution of the disclosure. It's well known that Mn is an important element for enlarging the austenite phase region, and it can reduce the critical quenching rate of steel, stabilize austenite, refine grains, and delay transformation of austenite to pearlite. According to the disclosure, since the carbon content is low, an increased Mn content can make up the strength loss caused by the low carbon content on the one hand, and it can also refine grains on the other hand to ensure acquisition of a relatively high yield strength and good impact toughness. To guarantee the strength of a steel plate, the Mn content should generally be controlled at 1.5% or higher. However, the Mn content should generally not exceed 2.5%; otherwise, segregation of Mn tends to occur in steel making, and hot cracking also tends to occur in continuous casting of a slab, undesirable for increasing the production efficiency. Moreover, a high Mn content will bring a high carbon equivalent to the steel plate, and cracks tend to be generated during welding. Therefore, the Mn content in the steel is generally controlled at 1.5-2.5%, preferably 1.8-2.2%.

Phosphorus is an impurity element in steel. P has a strong propensity to segregate to a grain boundary. When the P content in the steel is relatively high (≥0.1%), $Fe_2P$ will form and precipitate around the grains, leading to decreased plasticity and toughness of the steel. Therefore, its content should be as low as possible. Generally, it's desirable to control its content within 0.015%, so that the steel making cost will not be increased.

Sulfur is an impurity element in steel. S in the steel often combines with Mn to form MnS impurity. Particularly, when the contents of both S and Mn are relatively high, a large amount of MnS will form in the steel. MnS has certain plasticity itself, and it will deform in the rolling direction in a subsequent rolling process, so that the lateral tensile behavior of the steel plate will be degraded. Therefore, the S content in the steel should be as low as possible. In practical production, it's generally controlled within 0.005%.

Aluminum is a common deoxygenating agent in steel. In addition, Al may also combine with N in the steel to form AlN and refine grains. An Al content in the range of 0.02-0.10% has an obvious effect of refining austenite grains. Beyond this range, austenite grains will be too coarse, which is undesirable for the steel properties. Therefore, the Al content in the steel needs to be controlled in a suitable range, generally in the range of 0.02-0.1%.

Nitrogen is an impurity element in the disclosure, and its content should be as low as possible. N is also an unavoidable element in steel. Generally, the residual content of N in the steel is in the range of 0.002-0.004%. The solid dissolved or free N element can be immobilized by bonding with acid soluble Al. To avoid increasing the steel making cost, it's acceptable to control the N content within 0.006%, preferably less than 0.004%.

Niobium is an important element added in the technical solution of the disclosure. It's well known that addition of a trace amount of Nb in steel can increase the non-recrystallization temperature of the steel. In a rolling process, the formation of deformed and hardened austenite grains by controlling the finishing rolling temperature and increasing the rolling reduction rate is favorable for the deformed austenite grains to acquire finer structure in a subsequent process of cooling and phase change, so as to increase the strength and impact toughness of the steel. In addition, as proven theoretically and experimentally, combined addition of Nb and Ti is most effective in refining austenite grains. According to the disclosure, the amounts of Nb and Ti added in combination should satisfy $0.03\% \leq Nb+Ti \leq 0.06\%$.

Titanium is added in an amount in correspondence to the amount of nitrogen added in the steel. When the contents of Ti and N in the steel are controlled in relatively low ranges, a large amount of fine dispersed TiN particles in the steel during rot rolling. At the same time, it's necessary to control Ti/N below 3.42 to ensure that titanium forms TiN entirely. Fine nano-scale TiN particles having good high-temperature stability can refine austenite grains effectively in rolling. If Ti/N is greater than 3.42, relatively coarse TiN particles tend to form in the steel, which will affect the impact toughness of a steel plate undesirably. Coarse TiN particles may become a crack source for fracture. On the other hand, the Ti content cannot be too low; otherwise, the TiN particles will be formed in an amount too small to refine austenite grains. Therefore, the titanium content in the steel should be controlled in a suitable range. Titanium is generally added in an amount of 0.01-0.03%.

Chromium is an important element in the technical solution of the disclosure. Without incorporation of other alloy elements, ultralow-carbon steel itself will have poor hardenability, and a relatively thick steel plate can hardly obtain martensite structure in its entirety, possibly comprising a certain amount of bainite, which will certainly decrease the steel strength. Addition of chromium to the ultralow-carbon steel can promote the hardenability of the steel. Meanwhile, due to the addition of chromium, martensite structure obtained in the steel after quenching and cooling will be finer and have a quasiacicular feature, which is helpful for increasing strength and impact toughness. If the chromium content is too low, its effect of increasing the hardenability of the ultralow-carbon steel will be limited. Therefore, it's desirable to control the chromium content in the range of 0.1-0.5%.

Molybdenum is an important element in the technical solution of the disclosure. Molybdenum can increase the hardenability of steel, and delay pearlite transformation obviously. The primary purpose of incorporation of molybdenum into the technical solution of the disclosure is to increase the temper softening resistance of ultralow-carbon martensitic steel. Generally, only when its content is 0.1% or higher can molybdenum act to improve the hardenability and temper softening resistance. In view of the fact that molybdenum is a precious metal, its amount is generally controlled at 0.5% or less. Therefore, the molybdenum content is controlled in the range of 0.1-0.5%. As chromium and molybdenum are somewhat similar in their abilities of increasing hardenability and temper softening resistance of ultralow-carbon martensitic steel, they can be interchanged partially. According to the disclosure, the combined amount of chromium and molybdenum should satisfy $0.3\% \leq Cr+Mo \leq 0.6\%$.

Boron is an important element in the technical solution of the disclosure. Addition of boron to ultralow-carbon steel can increase the critical quenching rate of the steel. Addition of a trace amount of boron can increase the critical quenching rate 2-3 times, such that a relatively thick steel plate can still obtain ultralow-carbon martensite structure in its entirety during on-line quenching. The addition of boron to the steel can also inhibit precipitation of ferrite first by co-precipitation, so as to obtain ultrahigh-strength steel. Only when the boron content is greater than 5 ppm can boron act to increase hardenability. However, boron cannot be added in an unduly high amount; otherwise, the redundant boron will segregate near a grain boundary, and bond with nitrogen in the steel to form brittle precipitates such as BN and the like, thereby decreasing the bonding strength of the grain boundary and reducing the low-temperature impact toughness of the steel significantly. Therefore, the boron content is generally controlled in the range of 5-25 ppm which is sufficient to afford good effects.

It's to be particularly noted that Nb, Ti, Cr, Mo and B each are actually very critical in the compositional design according to the disclosure. Because the carbon content in the steel is very low by itself, and the hardenability is thus relatively low accordingly, a very high critical quenching rate, generally 100° C./s or even higher, is required to obtain martensite. Such a quenching rate is a cooling rate that is out of reach for some relatively thick steel coils. Hence, in order to decrease the critical quenching rate, addition of B is one of the feasible economical means. The main purposes of addition of Nb and Ti have already been described with reference to the functions of the elements. It's to be noted that, although the addition of Nb and Ti in combination can afford finer austenite grains, the critical quenching rate increases as the austenite grains become smaller. A conflict exists actually therebetween to some degree. Therefore, in such a sense, addition of Cr and Mo in continuation is a key to ensure acquisition of martensite at a relatively low quenching rate. In addition, the addition of Cr and Mo also has a very important effect of alleviating softening of a welding heat affected zone. Although the matrix structure of the steel is high-strength ultralow-carbon martensite, certain amounts of Cr and Mo must be added to ensure that the heat affected zone should not soften after welding of the steel plate. Hence, the selection of Nb, Ti, Cr, Mo and B and the determination of the contents thereof are very important.

Oxygen is an unavoidable element in steel making. For the present disclosure, the oxygen content in the steel is generally 30 ppm or lower after deoxygenation with Al, and thus there is no obvious negative influence on the properties of the steel plate. Therefore, it's acceptable to control the oxygen content in the steel within 0.0003%.

A method of manufacturing a high-toughness hot-rolled high-strength steel with a yield strength of Grade 800 MPa according to the disclosure comprises the following steps:

1) Smelting and casting

A composition as described above is smelted in a converter or electrical furnace, subjected to secondary refining in a vacuum furnace, and cast to a cast blank or ingot;

2) Heating

The cast blank or ingot is heated, wherein the heating temperature is 1100-1200° C., and the hold time is 1-2 hours;

3) Hot rolling

The initial rolling temperature is 1000-1100° C. Multi-pass large reduction rolling is conducted at a temperature of 950° C. or higher with an accumulated deformation rate ≥50%. Subsequently, the intermediate blank is held till 900-950° C. Then, the last 3-5 paths of rolling are conducted with an accumulated deformation rate ≥70%.

4) On-line quenching process

Rapid on-line quenching is conducted at a cooling rate ≥5° C./s from a temperature that is 800-900° C. above the temperature at which ferrite begins to precipitate to a temperature below Ms or room temperature to obtain fine ultralow-carbon lath martensite.

In the manufacture method of the disclosure, if the temperature for heating the steel blank is lower than 1100° C. or the hold time is too short, it will be undesirable for homogenization of the alloy elements; if the temperature is higher than 1200° C., not only the manufacture cost will be increased, but also the quality of the heating for the steel blank will be somewhat degraded. Therefore, it's desirable to control the temperature for heating the steel blank at 1100-1200° C.

Similarly, the hold time also needs to be controlled in a certain range. If the hold time is too short, the diffusion of solute atoms such as Si, Mn and the like will be insufficient to guarantee the quality of the heating for the steel blank; if the hold time is too long, austenite grains will be large and the manufacture cost will be increased. Therefore, the hold time should be controlled in the range of 1-2 hours. If the heating temperature is increased, the hold time can accordingly be shortened appropriately.

It's beneficial for refining grains to control the finishing rolling temperature, and particularly minimize the finishing rolling temperature in the required range as the rolling process is concerned.

The beneficial effects of the disclosure include:

According to the disclosure, excellent low-temperature or ultralow-temperature impact toughness in addition to high strength can be obtained by design of a brand-new ultralow-carbon martensite structure. A combination of Nb and Ti is added with the amounts thereof controlled in certain ranges to minimize the prior austenite grain size, and thus reduce the martensitic lath size in the ultralow-carbon martensite structure. In addition, a combination of Cr and Mo is added in the ranges as required to improve the hardenability and temper softening resistance of the steel. The Mn content is controlled in a relatively higher range to compensate the strength loss caused by the decrease of the carbon content, and refine the martensite structure as well. Based on the reasonable compositional design, a high-strength structural steel having a yield strength of greater than 800 MPa and excellent low-temperature impact toughness can be manufactured simply by using a continuous hot rolling process and on-line quenching. This high-strength structural steel may be used in industries where engineering machines are used in low-temperature environments.

The technology provided by the disclosure can be used for manufacturing a high-toughness hot-rolled high-strength steel having a yield strength ≥800 MPa, a tensile strength ≥900 MPa and a thickness of 3-12 mm, and a steel plate made therefrom has excellent low-temperature impact toughness and favorable elongation (≥13%). The steel plate shows that high strength, high toughness and good plasticity are matched extremely well, and thus provides the following beneficial effects in several aspects:

1. The steel plate exhibits excellent matching of strength, toughness and plasticity. The technology provided by the disclosure can be used to afford a yield strength of 800 MPa or higher, an elongation ≥13%, and particularly excellent low-temperature impact toughness. The impact energy of the steel plate is sustained at 0° C. to −80° C., showing ultrahigh impact toughness. Its ductile-brittle transition temperature is below −80° C. The steel plate can be used widely in industries where engineering machines are used in low-temperature environments.

2. When the technology provided by the disclosure is put into practice, the production process is simple. A hot-rolled high-strength high-toughness structural steel having excellent low-temperature impact toughness can be produced by using on-line quenching to below Ms in a simply production process, and the steel plate has excellent properties.

BRIEF DESCRIPTION OF DRAWINGS

The specific features and performances of the disclosure will be set out with reference to the following examples and drawings.

BEST MODES FOR CARRYING OUT THE DISCLOSURE

The disclosure will be further illustrated with reference to the following Examples and accompanying drawings.

The steel compositions of the Examples according to the disclosure are listed in Table 1. Table 2 shows the process for manufacturing the steel of the Examples according to the disclosure. Table 3 shows the mechanical properties of the steel of the Examples according to the disclosure.

Figure 1:
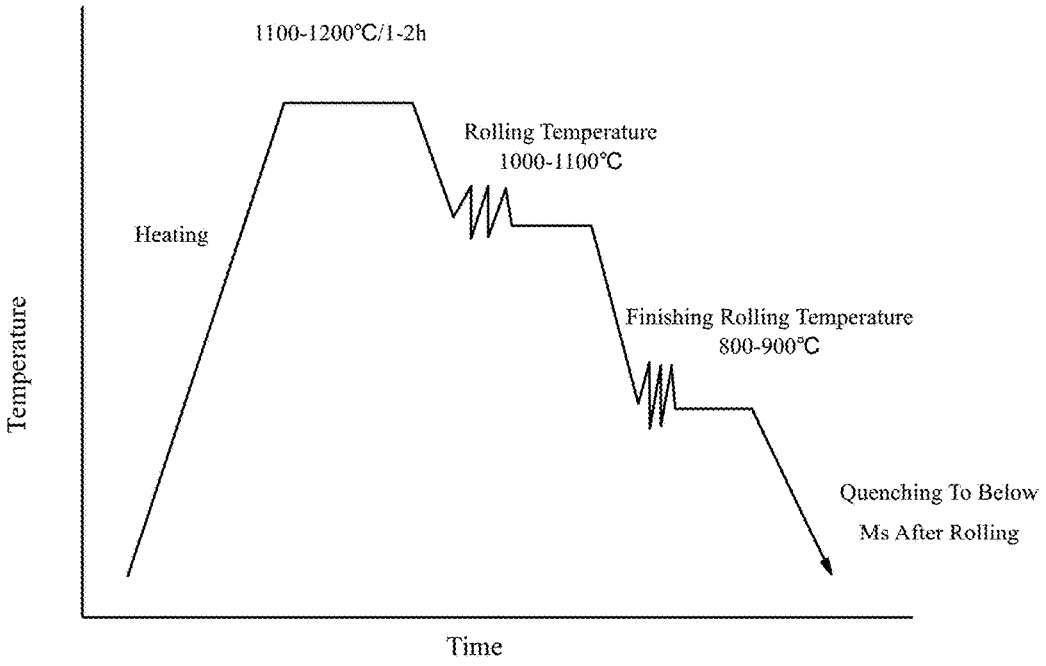
FIG. 1 is a schematic view of the manufacture process of the disclosure.
Figure 2:
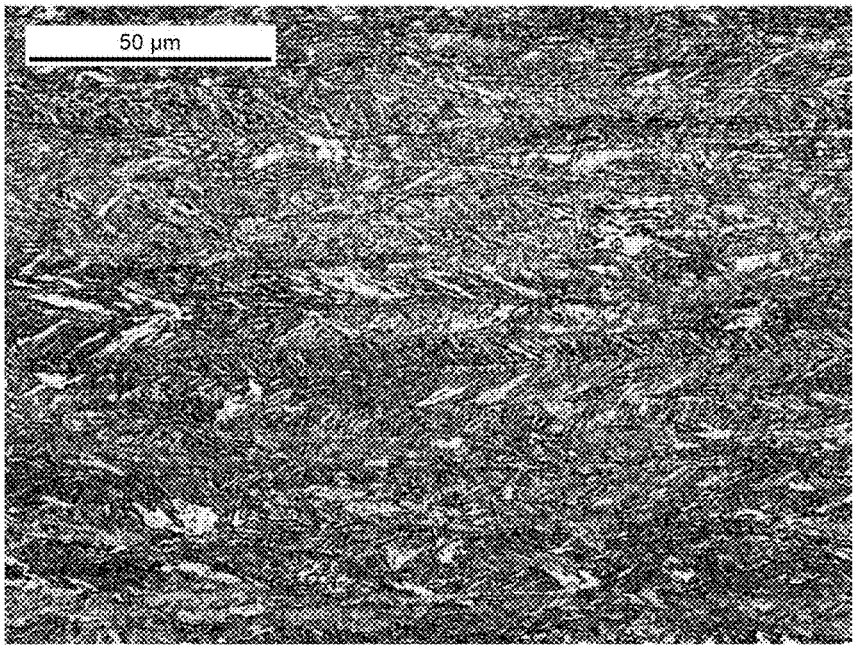
FIG. 2 is a typical metallographical photo of the steel of Example 1 according to the disclosure.
Figure 3:
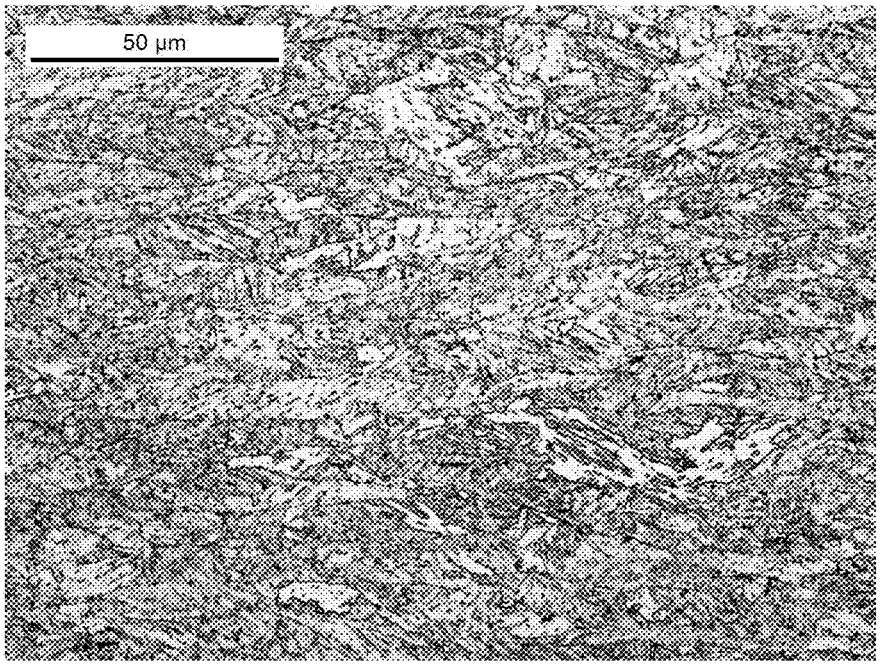
FIG. 3 is a typical metallographical photo of the steel of Example 2 according to the disclosure.
Figure 4:
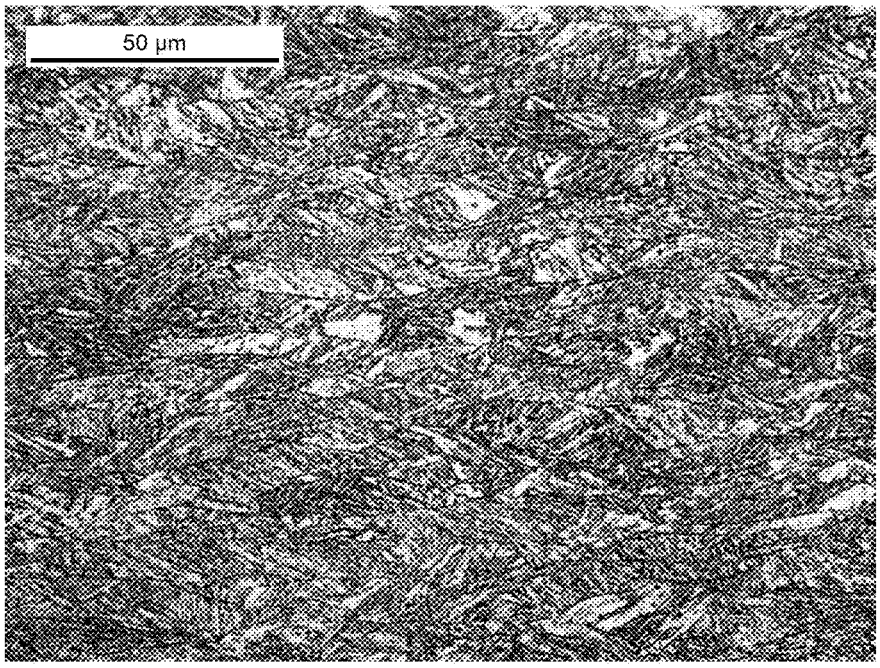
FIG. 4 is a typical metallographical photo of the steel of Example 3 according to the disclosure.
Figure 5:
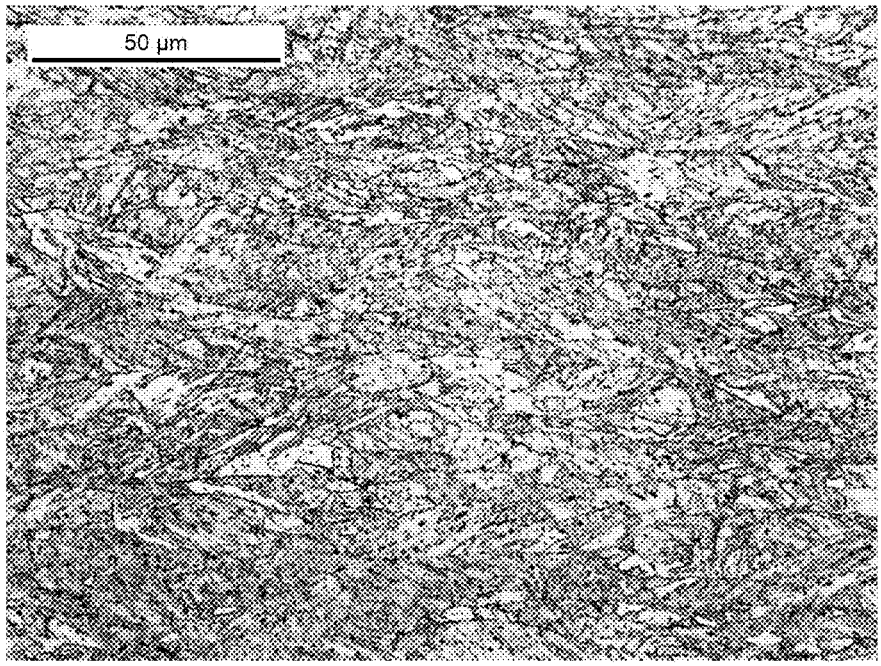
FIG. 5 is a typical metallographical photo of the steel of Example 4 according to the disclosure.
Figure 6:
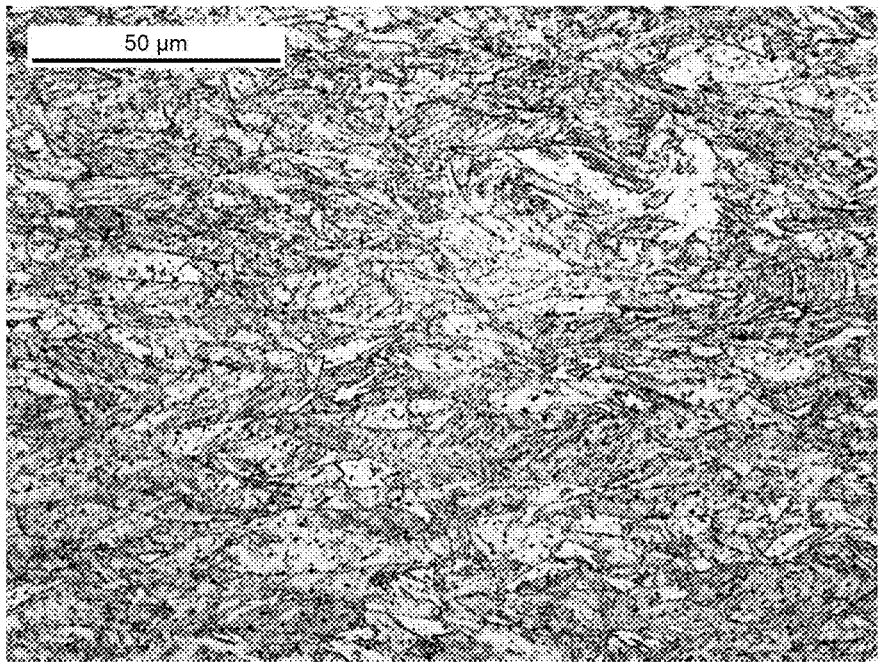
FIG. 6 is a typical metallographical photo of the steel of Example 5 according to the disclosure.

The process flow of the Examples according to the disclosure: smelting in a converter or electrical furnace→secondary refining in a vacuum furnace→casting blank (ingot)→reheating the cast blank (ingot)→hot rolling+on-line quenching→steel coiling, wherein the temperature for heating the cast blank (ingot) was 1100-1200° C.; the hold time was 1-2 hours; the initial rolling temperature was 1000-1100° C.; multi-pass large reduction rolling was conducted at temperatures of 950° C. and higher, and the accumulated deformation rate was ≥50%; subsequently, the intermediate blank was held till 900-950° C.; then, the last 3-5 paths of rolling were conducted, and the accumulated deformation rate was ≥70%; rapid on-line quenching was conducted at a cooling rate ≥5° C./s from a temperature that was 800-900° C. above the temperature at which ferrite began to precipitate to a temperature below Ms or room temperature to obtain fine ultralow-carbon lath martensite, as shown by FIG. 1.

TABLE 1 unit: weight %

| Ex. | C | Si | Mn | P | S | Al | N | O | Nb | Ti | Cr | Mo | B |
|---|---|---|---|---|---|---|---|---|---|---|---|---|---|
| 1 | 0.02 | 0.45 | 2.47 | 0.006 | 0.003 | 0.08 | 0.0032 | 0.0026 | 0.05 | 0.01 | 0.28 | 0.22 | 0.0025 |
| 2 | 0.03 | 0.28 | 1.91 | 0.007 | 0.004 | 0.09 | 0.0033 | 0.0024 | 0.02 | 0.02 | 0.41 | 0.13 | 0.0015 |
| 3 | 0.03 | 0.49 | 1.55 | 0.009 | 0.003 | 0.02 | 0.0046 | 0.0023 | 0.01 | 0.03 | 0.45 | 0.14 | 0.0020 |
| 4 | 0.04 | 0.35 | 1.74 | 0.010 | 0.005 | 0.04 | 0.0036 | 0.0028 | 0.04 | 0.01 | 0.23 | 0.35 | 0.0010 |
| 5 | 0.05 | 0.11 | 2.25 | 0.008 | 0.006 | 0.07 | 0.0040 | 0.0029 | 0.03 | 0.02 | 0.10 | 0.28 | 0.0005 |

TABLE 2

| Ex. | Heating Temperature ° C. | Finishing rolling Temperature ° C. | Steel Plate Thickness mm | Critical Cooling Rate ° C./s | End Cooling Temperature In Quenching ° C. |
|---|---|---|---|---|---|
| 1 | 1150 | 900 | 3 | 5 | Room Temperature |
| 2 | 1100 | 880 | 6 | 13 | 350 |
| 3 | 1200 | 850 | 8 | 24 | Room Temperature |
| 4 | 1150 | 800 | 10 | 7 | 150 |
| 5 | 1200 | 830 | 12 | 13 | 250 |

Note:
Steel blank thickness 120 mm.

TABLE 3

Mechanical Properties Of Steel Plates

| Ex. | Yield Strength Rp0.2 MPa | Tensile Strength Rm MPa | Elongation A % | Yield Ratio Rp0.2/Rm | Impact Energy (−80° C.) |
|---|---|---|---|---|---|
| 1 | 805 | 903 | 15.0 | 0.89 | 162 |
| 2 | 814 | 928 | 14.0 | 0.88 | 162 |
| 3 | 820 | 939 | 14.0 | 0.87 | 158 |
| 4 | 834 | 946 | 14.5 | 0.88 | 144 |
| 5 | 856 | 943 | 13.0 | 0.91 | 156 |

FIGS. 2-6 show the typical metallographical photos of the test steel of Examples 1-5.

As can be seen clearly from the metallographical photos, the structure of the steel plates is fine lath martensite. As can be seen clearly in the rolling direction, the prior austenite grain boundary has a tabular shape with a width of about 6-7

μm, having a fine prior austenite equivalent grain size. The finer the prior austenite grains, the smaller the lath after the steel plate is quenched, leading to higher strength and better low-temperature impact toughness. As can be discovered by observation through SEM, when the steel plate was quenched to room temperature, carbides have no time to form, and thus the structure is substantially free of carbides. When quenched to different temperatures such as 150° C., 250° C. and 350° C., the structure of the steel plate comprises a certain number of carbides. Since the alloy itself is designed to comprise ultralow carbon, the amount of the carbides precipitated is limited, and these carbides contribute little to the strength.

To sum up, the design concept of the disclosure is the use of ultralow-carbon martensite, wherein austenite grain size is reduced by combined addition of Nb and Ti; hardenability and temper softening resistance are improved by combined addition of Cr and Mo; a hot continuous rolling process is utilized to obtain ultralow-carbon martensite structure by direct quenching or low-temperature coiling, wherein in addition to high strength (yield strength ≥800 MPa), the resulting steel still exhibits excellent impact toughness (impact energy at −80° C.>100 J, and in fact almost being 150 J or higher for all the Examples) when kept at −80° C. These properties cannot be achieved by presently similar steel design concept based on ultralow-carbon bainite, wherein the strength is low while the impact toughness is close to that in the disclosure; or the strength is close to that in the disclosure, but the impact toughness is poorer. The disclosure combines these two advantages.

What is claimed is:

1. A high-toughness hot-rolled high-strength steel with a yield strength of Grade 800 MPa, consisting of, in weight percentages: C 0.02-0.05%, Si≤0.5%, Mn 1.5-2.5%), P≤0.015%), S≤0.005%, Al 0.02-0.10%, N≤0.006%), Nb 0.01-0.05%), Ti 0.01-0.03%, 0.03%≤Nb+Ti≤0.06%, Cr 0.1%-0.5%, Mo 0.1-0.5%, B 0.0005-0.0025%, and the balance of Fe and unavailable impurities.

2. The high-toughness hot-rolled high-strength steel with a yield strength of Grade 800 MPa of claim 1, wherein the hot-rolled high-strength steel has a yield strength ≥800 MPa, a tensile strength ≥900 MPa, an elongation ≥13%, and an impact energy at −80° C. of 100 J or higher.

3. The high-toughness hot-rolled high-strength steel with a yield strength of Grade 800 MPa of claim 1, wherein the hot-rolled high-strength steel has a microstructure of lath martensite.

4. A method of manufacturing the high-toughness hot-rolled high-strength steel with a yield strength of Grade 800 MPa, comprising the following steps:

1) Smelting and casting

A composition of claim 1 is smelted in a converter or electrical furnace, subjected to secondary refining in a vacuum furnace, and cast to a cast blank or ingot;

2) Heating

The cast blank or ingot is heated, wherein the heating temperature is 1100-1200° C., and the hold time is 1-2 hours;

3) Hot rolling

The initial rolling temperature is 1000-1100° C.; multi-pass large reduction rolling is conducted at a temperature of 950° C. or higher with an accumulated deformation rate ≥50%; subsequently, an intermediate blank is held till 900-950° C.; and then, the last 3-5 paths of rolling are conducted with an accumulated deformation rate ≥70%;

4) On-line quenching process

Rapid on-line quenching is conducted at a cooling rate ≥5° C./s from a temperature that is 800-900° C. above the temperature at which ferrite begins to precipitate to a temperature below Ms or room temperature to obtain fine ultralow-carbon lath martensite.

5. The method of manufacturing the high-toughness hot-rolled high-strength steel with a yield strength of Grade 800 MPa according to claim 4, wherein the hot-rolled high-strength steel has a yield strength ≥800 MPa, a tensile strength ≥900 MPa, an elongation ≥13%, and an impact energy at −80° C. of 100 J or higher.

6. The method of manufacturing the high-toughness hot-rolled high-strength steel with a yield strength of Grade 800 MPa according to claim 4, wherein the hot-rolled high-strength steel has a microstructure of lath martensite.

7. The method of manufacturing the high-toughness hot-rolled high-strength steel with a yield strength of Grade 800 MPa according to claim 5, wherein the hot-rolled high-strength steel has a microstructure of lath martensite.

8. The high-toughness hot-rolled high-strength steel with a yield strength of Grade 800 MPa of claim 2, wherein the hot-rolled high-strength steel has a microstructure of lath martensite.

9. The high-toughness hot-rolled high-strength steel with a yield strength of Grade 800 MPa of claim 1, wherein the thickness of the steel is in the range of 3-12 mm.

10. The method of manufacturing the high-toughness hot-rolled high-strength steel with a yield strength of Grade 800 MPa according to claim 4, wherein the thickness of the steel is in the range of 3-12 mm.

* * * * *